US008291662B2

(12) United States Patent
McCorkle

(10) Patent No.: US 8,291,662 B2
(45) Date of Patent: Oct. 23, 2012

(54) CONTINUOUS POUR CONCRETE SLIP DOWEL

(75) Inventor: Dale McCorkle, Pittsburgh, PA (US)

(73) Assignee: TDJ Masonry Inc., Tampa, FL (US)

( * ) Notice: Subject to any disclaimer, the term of this patent is extended or adjusted under 35 U.S.C. 154(b) by 0 days.

(21) Appl. No.: 12/986,040

(22) Filed: Jan. 6, 2011

(65) Prior Publication Data

US 2012/0011794 A1 Jan. 19, 2012

Related U.S. Application Data

(60) Provisional application No. 61/292,658, filed on Jan. 6, 2010.

(51) Int. Cl.

| | |
|---|---|
| ***E04B 1/686*** | (2006.01) |
| ***E04B 1/68*** | (2006.01) |
| ***E04F 15/14*** | (2006.01) |
| ***E04F 15/22*** | (2006.01) |

(52) U.S. Cl. ..... 52/396.02; 52/393; 52/396.04; 52/396.05; 52/396.08

(58) Field of Classification Search ..... 52/396.02, 52/393, 396.04, 396.05, 396.08
See application file for complete search history.

(56) References Cited

U.S. PATENT DOCUMENTS

| | | | | |
|---|---|---|---|---|
| 1,289,688 | A * | 12/1918 | Davis | 404/68 |
| 1,637,742 | A * | 8/1927 | Edge et al. | 52/685 |
| 2,152,751 | A | 4/1939 | Schulz | |
| 2,375,361 | A * | 5/1945 | Hillberg | 52/686 |
| 2,858,748 | A * | 11/1958 | Crone | 404/59 |
| 3,385,017 | A * | 5/1968 | Williams | 52/378 |
| 3,397,626 | A | 8/1968 | Kornick et al. | |
| 3,437,018 | A | 4/1969 | Jackson | |
| 4,449,844 | A | 5/1984 | Larsen | |
| 4,578,916 | A | 4/1986 | Witschi | |
| 4,648,739 | A | 3/1987 | Thomsen | |
| 4,733,513 | A | 3/1988 | Schrader et al. | |
| 4,959,940 | A | 10/1990 | Witschi | |
| 5,005,331 | A | 4/1991 | Shaw et al. | |
| 5,216,862 | A | 6/1993 | Shaw et al. | |
| 5,487,249 | A | 1/1996 | Shaw et al. | |
| 5,678,952 | A | 10/1997 | Shaw et al. | |
| 5,797,231 | A | 8/1998 | Kramer | |
| 5,934,821 | A | 8/1999 | Shaw et al. | |
| 6,502,359 | B1 | 1/2003 | Rambo | |

(Continued)

OTHER PUBLICATIONS

Reported by ACI Committee 302, Guide for Concrete Floor and Slab Construction, American Concrete Institute, p. 302.1R-11, ACI 302.1R-96, ACI 3021R-96 became effective Oct. 22, 1996. This document supersedes ACI 302.1R-89.

(Continued)

*Primary Examiner* — Mark Wendell
(74) *Attorney, Agent, or Firm* — Blynn L. Shideler; Krisanne Shideler; BLK Law Group

(57) ABSTRACT

According to one non-limiting embodiment of the present invention, a continuous pour concrete slip dowel is disclosed configured for use across a joint between adjacent concrete slabs. The continuous pour concrete slip dowel of the invention includes a slip sleeve configured to be positioned within a first concrete slab, and a main dowel rod having i) a first rod end portion configured to be received within the slip sleeve, ii) a second opposed rod end configured to be received within a second concrete slab which is adjacent the first slab and spaced from the first slab by a intervening joint, and iii) an intermediate coupling rod portion connecting the first rod end with the second rod end, wherein the coupling rod portion defines an offset therein whereby the coupling rod portion is configured to extend around the joint.

20 Claims, 3 Drawing Sheets

U.S. PATENT DOCUMENTS

| | | | | |
|---|---|---|---|---|
| 7,547,158 | B1 * | 6/2009 | Mucci | 404/47 |
| 2003/0033778 | A1 * | 2/2003 | Boxall et al. | 52/396.02 |
| 2008/0263981 | A1 * | 10/2008 | O'Brien | 52/396.02 |
| 2010/0281808 | A1 * | 11/2010 | Laiho et al. | 52/402 |
| 2010/0325995 | A1 * | 12/2010 | Laiho et al. | 52/393 |
| 2010/0325996 | A1 * | 12/2010 | Laiho et al. | 52/396.05 |

OTHER PUBLICATIONS

Reported by ACI Committee 224, Joints in Concrete Construction, American Concrete Institute, p. 224.3R-21 and p. 224.3R-21, ACI 224.3R-95 became effective Aug. 1, 1995.

* cited by examiner 12
32
16
14
10
34
36
38

CONTINUOUS POUR CONCRETE SLIP DOWEL

RELATED APPLICATIONS

The present invention claims priority of U.S. Provisional Patent Application Ser. No. 61/292,658 entitled "Continuous Pour Concrete Slip Dowel" filed Jan. 6, 2010.

BACKGROUND OF THE INVENTION

1. Field of the Invention

The present invention relates to concrete construction and more particularly, the present invention is directed to a concrete slip dowel which allows for continuous pours.

2. Background Information

U.S. Pat. Nos. 2,152,751; 3,437,018; 4,578,916; 4,733,513; 4,959,940; 5,005,331; 5,216,862; 5,487,249; 5,678,952; 5,797,231; 5,934,821; 6,502,359 provide, collectively, a meaningful background discussion in this field noting that in the art of concrete construction, it is commonplace to form joints between two or more poured concrete slabs allowing for thermal expansion of each slab. This type of joint is called an expansion joint. An expansion joint is formed by the placement of compressible materials consisting typically of wood or, more commonly, a composite fiber material at regular intervals of the concrete structure between the slabs. The compressible material allows expansion of the concrete, after curing, beyond its original volume. In order to prevent preventing buckling or relative angular displacement between adjacent slaps at such joints, it is common practice to insert steel dowel rods, generally known as "slip dowels", within the edge portions of adjoining concrete slabs in such a manner that the concrete slabs may slide freely, i.e. "slip", along the axis of the slip dowel or dowels, thereby permitting linear expansion and contraction of the slabs while at the same time maintaining the slabs in a common plane and thus preventing undesirable bucking or unevenness of the slabs at the joint.

A second such joint that controls contraction due to loss of moisture during curing is a control joint. Control joints are more prevalent and must be placed every 100 to 200 square feet of surface area. While a control joint protects the concrete slab from damage due to contraction of the concrete during curing and expansion or contraction thereafter within the slab itself, the joints prohibit loads placed on the concrete slab to be transferred uniformly throughout. As a result, control joints, without further reinforcement, leave the concrete slabs susceptible to damage. For instance, loads developed by a forklift moving across a non-reinforced control joint poses a serious risk of damage to the slab because the forklift's load at the control joint is supported by only one half of the volume of concrete as available to support the forklift in an portion of the slab without a control joint.

This coupling of adjacent slabs with a slip dowel represents an accepted load transfer methodology between the slabs, as noted by the American Concrete Institute (ACI) in 224.3R-205.2.4 that states "Load transfer is accomplished through aggregate interlock, through preformed key, or by the use of a doweled joint." ACI also noted that "For dowels to be effective, they should be smooth, aligned and supported so they will remain parallel in both the horizontal and the vertical planes during the placing and finishing operation. Properly aligned, smooth dowels allow the joint to open as concrete shrinks." (See ACI 302.1R-10 3.2.7) Further ACI notes that "The dowels should be centered on the joint. To permit horizontal movement, dowels must not bond to the concrete on at least one side." (See ACI 224.3R-20 5.2.4.). In addition to control or expansion joints, these joints are also referenced apparently collectively, as "cold joints" in the art as cited in U.S. Pat. Nos. 5,005,331 and 5,487,249.

As noted, in order to function effectively, slip dowels must be accurately positioned parallel within the adjoining concrete slabs. The non-parallel positioning of the dowels will prevent the desired slippage of the dowels and will defeat the purpose of the "slip dowel" application. Additionally, the individual dowels must be placed within one or both of the slabs in such a manner as to permit continual slippage or movement of the dowels within the cured concrete slab(s).

U.S. Pat. No. 4,449,844 discloses similar slip dowel construction for concrete but addressing specific issues associated with highway concrete construction. Similarly U.S. Pat. No. 4,648,739 is related to concrete road construction and associated slip dowel usage, with this patent stating that doweled transverse joints are designed to provide load transfer between adjacent concrete panels, confine pavement cracking to predetermined locations directly over the steel dowel bar assemblies and minimize faulting of concrete panels at the joint area, but that the type of transverse joints currently utilized (at the time of filing of the patent application issuing as the '739 patent) "has been recognized by Federal Research studies as the cause of 90 to 95 percent of all concrete pavement performance problems" and wherein this "deficiency limits the life of otherwise durable concrete material to 15 to 25 years of services".

The prior art dowels are often made of rebar, however smooth, lubricated, or coated entirely with plastic structures are known as disclosed in U.S. Pat. No. 3,397,626. The designs are developed to prevent the dowel from bonding to the concrete and allow the concrete slab or structure to slide relative to the dowel in a direction substantially perpendicular to the axis defined by the joint. Such movement of the slab relative to the dowel prevents build up of stress in the dowel that may result in cracking of the concrete.

In the prior art, several general methods of installing "slip dowels" have become popular. The following descriptions of existing methods will reference analogous components by reference numeral from the drawings showing the applicant's invention in an effort to better illustrate the operation of the prior art and to better highlight the advantages of the present invention. The following description of the known systems is not intended to suggest that the invention set forth in the figures of this patent application is a prior art system or method. A detailed description and understanding of the prior art methods and slip dowel systems will make the description of the present invention simple and allow the advantages to be more fully understood i. Drilling into an Edge of a First Pour According to a first method, a first concrete pour (similar to slab 18 in the attached drawings) is made within a pre-existing form. After the first pour has cured, an edge of the form (usually a wooden stud, similar to frame member 14 in the attached drawings) is stripped away. A series of holes are then drilled parallel into the first pour or slab 18 along the exposed edge from which the form or member 14 has been removed. The depth and diameter of the individual holes varies depending on the application and the relative size of the concrete slabs 18 to be supported. As a general rule, however, such holes are at least twelve (12) inches deep and typically have a diameter of approximately five-eighths (5/8) of an inch.

After the parallel aligned series of holes has been drilled into the first pour or slab 18, dowel rods (generally formed of rebar) are advanced into each such hole such that one end of each dowel rod is positioned within the first pour and the remainder of each dowel rod extends into a neighboring area where a second slab (such as slab 20 of the attached figures) of concrete is to be poured. Thereafter, concrete is poured into such neighboring area and is permitted to set with the parallel aligned dowels extending into the area of the second slab 20 pour. After the second pour or slab 20 has set, the slip dowels will be held firmly within the second slab but will be permitted to slide longitudinally within the drilled holes of the first slab thereby accommodating longitudinal expansion and contraction of the two slabs while at the same time preventing buckling or angular movement there between.

Although the above described "drilling method" of placing slip dowels has become well known, it will be appreciated that such method is extremely labor intensive. In fact, it takes approximately ten minutes to drill a five-eighths inch diameter by twelve inches long hole into the first pour, and the drilling equipment, bits, accessories, and associated set up time tends to be very expensive. Moreover, the laborers who drill the holes and place the slip dowels must be adequately trained to insure that the dowels are arranged perpendicular to the joint but parallel to one another so as to permit the desired slippage during subsequent use. Further the drilling is often through the expansion joint members (such as expansion member 16) used between adjacent concrete slabs 18 and 20.

ii. Sleeved Slip Dowel Set Method

A second popular method of placing slip dowels involves the use of slip sleeves, such as wax treated cardboard sleeves or premade plastic sleeves, positioned over one end of each individual dowel. According to such method, a series of holes are drilled through one edge of a concrete form (such as frame member 14) and smooth dowels are advanced through each such hole. Slip sleeves (similar to sleeve 12 of FIGS. 1-5) are placed over one end of each dowel and the first pour is made within the form, with the form holding the sleeved slip dowels in place. After the first pour has set forming a slab 18, the previously drilled form is stripped away, thus leaving the individual dowels extending into a neighboring open space where the second pour for an adjacent slab 20 is to be made. Subsequently, the second pour is made and permitted to cure forming an adjacent slab 20. Thereafter, the slip dowels will be firmly held by the concrete of the second pour or slab 20 but will be permitted to longitudinally slide against the inner surfaces of the slip sleeves 12 within the first pour. Thus, the slip sleeves 12 facilitate longitudinal slippage of the dowels, while at the same time holding the two concrete slabs 18 and 20 in a common plane, and preventing undesirable buckling or angular movement thereof.

This second method, while presently popular, is nonetheless associated with numerous deficiencies and is also labor intensive.

iii. Slip Sleeve Set Method

Another method known in the art which has become very popular is the use of slip sleeves 12 that are removeably mounted to and supported on one edge of the concrete form or frame member 14 in generally parallel relation to each other via base portions (no analogous member in the drawings) secured to the form or frame member 14, with a first pour being made thereabout to form slab 18. After the first pour has cured to form slab 18, the edge of the concrete form to which the slip sleeves 12 are mounted is stripped away from the first slab 18 together with the allegedly reusable mounting bases (basically ½ a dowel rod) leaving only the slip sleeves 12 within the first slab 18. The slip dowels are then advanced into the exposed open ends of the slip sleeves 12 embedded within the first slab 18. Those portions of the dowel rods not advanced into the slip sleeves extend into a neighboring area where a second pour of concrete is to be made to form adjacent slab 20. The pouring of the concrete into the neighboring area encapsulates the dowel rods which are held firmly within the second slab 20 formed by the curing of the second pour. The dowels, though being firmly held within the second slab 20, are permitted to slide longitudinally within the sleeves 12 (also called tubes) embedded in the first slab 18.

This method is currently commercialized by under the SPEED DOWEL™ brand by the Greenstreak company.

Though the use of these prior art placement devices presents advantages over the previously described placement methods, these devices also possess certain deficiencies which detract from their overall utility. It has been observed that the attachment of the base portions of these prior art placement devices to a concrete form or frame member 14 often requires the use of multiple fasteners, which makes the attachment process a difficult and time-consuming task.

It is an object of the present invention to address the deficiencies of the prior art discussed above and to do so in an efficient, cost effective manner.

SUMMARY OF THE INVENTION

The various embodiments and examples of the present invention as presented herein are understood to be illustrative of the present invention and not restrictive thereof and are non-limiting with respect to the scope of the invention.

According to one non-limiting embodiment of the present invention, a continuous pour concrete slip dowel is disclosed configured for use across a joint between adjacent concrete slabs.

The continuous pour concrete slip dowel of one embodiment of the present invention includes a main dowel rod having i) a first rod end portion configured to be slidingly received within the one concrete slab on a first side of a joint, ii) a second opposed rod end configured to be received within a second concrete slab which is adjacent the first slab and spaced from the first slab by the intervening joint, and iii) an intermediate coupling rod portion connecting the first rod end with the second rod end, wherein the coupling rod portion defines an offset therein whereby the coupling rod portion is configured to extend around the joint.

A sliding mechanism is associated with the first rod end to provide a sliding relationship between the first rod end and the concrete slab on the first side of the joint. The sliding mechanism in one embodiment can take the form of a slip sleeve configured to be positioned within a first concrete slab wherein the first rod end portion configured to be slidingly received within the slip sleeve. The sliding mechanism in one embodiment can take the form of a relatively smooth exterior of the first rod end which is coated to prevent attachment of the concrete during setting. The coating may be tar, pitch, grease, petroleum gels or the like which prevent the setting concrete from attaching to the first end of the rod during setting, thus the coating can be considered as forming a non-solid, or semisolid slip sleeve. The sliding mechanism in one embodiment can take the form of a relatively smooth exterior of the first rod end to minimize the attaching force of the setting concrete on the first slab side and projections on the second end of the second rod end to increase the attaching strength of the concrete to the main dowel rod on the second slab side, whereby a substantial difference in concrete attaching strength is provided on opposed rod ends of the main dowel and the first rod end will ultimately slip relative to slab contraction/expansion on that side to provide the needed sliding arrangement.

The continuous pour concrete slip dowel of one embodiment of the present invention includes a slip sleeve configured to be positioned within a first concrete slab, and a main dowel rod having i) a first rod end portion configured to be received within the slip sleeve, ii) a second opposed rod end configured to be received within a second concrete slab which is adjacent the first slab and spaced from the first slab by a intervening joint, and iii) an intermediate coupling rod portion connecting the first rod end with the second rod end, wherein the coupling rod portion defines an offset therein whereby the coupling rod portion is configured to extend around the joint.

These and other advantages of the present invention will be clarified in the description of the preferred embodiments taken together with the attached figures. The figures are schematic sketches only showing the invention for illustrative purposes and are not intended to show the scale of the various components.

DESCRIPTION OF THE PREFERRED EMBODIMENTS

Figures 1A, 1B, 2A, 2B, 2C, 7:
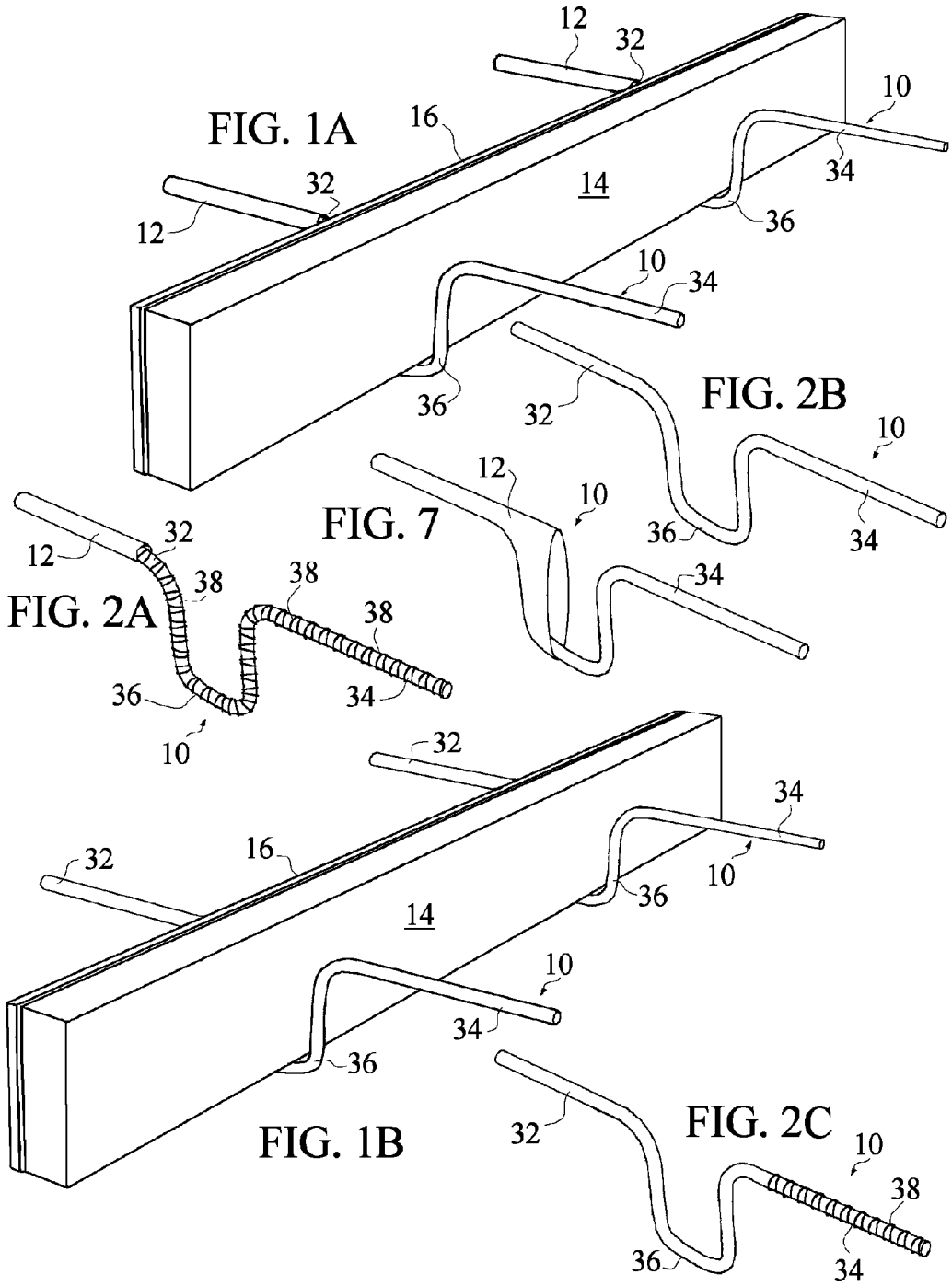
FIG. 1A is a schematic perspective view of a concrete slip dowel in position across a frame member with an expansion joint forming member in accordance with one non-limiting embodiment of the present invention.
FIG. 1B is a schematic perspective view of a concrete slip dowel in position across a frame member with an expansion joint forming member in accordance with another non-limiting embodiment of the present invention.
FIG. 2A is a schematic perspective view of the concrete slip dowel of FIG. 1A.
FIG. 2B is a schematic perspective view of the concrete slip dowel of FIG. 1B.
FIG. 2C is a schematic perspective view of an alternative concrete slip dowel for use as shown in FIG. 1B.
FIG. 7 is a schematic perspective view of the concrete slip dowel of FIG. 6.

In summary, the present invention relates to a continuous pour concrete slip dowel 10 which is disclosed configured for use across a joint, such as an expansion joint having an expansion member 16 between adjacent concrete slabs 18 and 20. The construction of the expansion member 16 is known in the art, but generally is formed of a rubber or other elastomeric material, or a composite of several materials, and configured to accommodate slab expansion and withstand the operating environment.

The continuous pour concrete slip dowel 10 of the invention includes a sliding mechanism that is associated with, at least, a first rod end 32 of the dowel 10 to provide a sliding relationship between the first rod end 32 and the concrete slab 18 on the first side of the joint formed by member 16.

In one embodiment of the present invention shown in FIGS. 1A, 2A, 3A, 4A, 5A, 6 and 7, the sliding mechanism is formed by a slip sleeve 12 configured to be positioned within the first concrete slab 18, and the main dowel rod 10 has i) a first rod end 32 configured to be received within the slip sleeve 12, ii) a second opposed rod end 34 configured to be received within a second concrete slab 20 which is adjacent the first slab 18 and the slab 20 being spaced from the first slab 18 by a intervening joint that may include an expansion member 16 or the like, and iii) an intermediate coupling rod portion 36 connecting the first rod end with the second rod end, wherein the coupling rod portion 36 defines an offset, such as through a U-Shaped configuration, therein whereby the coupling rod portion 36 is configured to extend around the joint and around expansion member 16, if any, via extension into the stone base 22.

As the rod 10 makes up the main component of the entire slip dowel arrangement, the term rod and dowel will be used effectively interchangeably throughout this application. The dowel assembly is inclusive of the slip sleeve 12 in the initial embodiment.

The dowel rod 10 can be formed of any suitable material such as from a rebar rod that is bent into the U shape as shown, generally consisting of four ninety degree bends. Rebar rod will traditionally have projections 38 (shown only in FIG. 2A, and omitted from other figures for clarity) on an outer surface thereof that are designed to greatly assists in the adhering of concrete to the bar where the setting concrete is in contact with the bar. The U-Shape as shown provides several advantages for manufacturing and for operation. First the U-shape allows for a sufficiently large radius in the bends, such as about 1 inch diameter to the inner surface of the rod in the bent portion, that conventional bending table, bending rolls, or bending presses can be used on a conventional rebar member, from about ¼ inch to 1 inch diameter rebar, to form the rod 10, without further heat treatment of the bent rod 10. Obviously, the rod 10 can be made in other methods, such as casting the rod 10 in a desired shape, or by hot working a bar or other known methods; however cold working a rebar member on conventional bending equipment is believed to provide certain cost advantages to the present invention.

A further advantage of the general U-shape for portion 36 as shown is the minimized direct contact between the portion 36 and the frame member 14 and the expansion member 16 and the portion 36. The minimal direct contact, which can also be called a line contact, with these components allows the frame member 14 to be more easily removed after the pour. The U-shape of portion 36 still closely approximates the expansion and frame member 14 and 16 so as to prevent any significant concrete around the inner leg side of the U-shape as shown, which allows the relative motion of the slabs 18 and 20.

As described above the rod 10 is easily formed by bending or cold working a rebar member of the appropriate length. It can be formed as follows. A ½ inch diameter steel rebar member with projections 38 of the desired length is inserted into a mechanical table bender with about 9-12 inches of the rebar member that will form one end 32 or 34 of the rod 10 extending beyond a first bending pin, which may be a two inch diameter pin. The rebar member is bent around the first pin to about ninety degrees, thus forming one end 32 or 34 of the rod 12 and the first bend of the U shaped intermediate coupling rod portion 36. A second pin, such as a two inch diameter pin, is provided on the table and the rebar member is bent around the second pin for 180 degrees (or two 90 degree bends) to form the bottom of the U shaped intermediate coupling rod portion 36. A third pin of the same diameter as the first pin is provided on the table and the rebar member is bent around the third pin to form the final upper bend of the U shaped intermediate coupling rod with about 9-12 inches beyond the bend to form the opposed end 32 or 34 of the rod.

A two inch diameter pin for forming the inside of the U shaped intermediate coupling rod allows the rod 10 to easily accommodate a 2×4 wooden frame member 14 and expansion member 16 as it is well known that 2×4 wooden members are, in actuality, less than 2 inches thick. The position of the second pin is such that the height (vertical distance) of the rod 12 from the lower end of the U shaped intermediate coupling rod portion 36 to the upper side of the end of the rod is about 4 inches to about 6 inches.

Each end 32 and 34 of the rod will extend approximately 9 inch to 12 inches and the ends 32 and 34 will preferably be co-axial and about the same length. The co-axial arrangement of the ends of the rod 10 allows the ends to be placed in the middle (top to bottom) of the respective slabs 18 and 20. An overall "height: of the rod 10 (also described as depth of the U shaped portion 36) of 4-6 inches allows the rod 10 to be used with most conventional concrete slab thicknesses. The ends of the rod 10 should be extending substantially in the middle of the slab 18 and 20 and perpendicular to the joint.

In operation the slip dowel 10 of the present invention operates as follows. The dowel 10 is appropriate for use whenever there is a joint between adjacent slabs 18 and 20 to be poured. The concrete contractor will place a plurality of the slip dowels 10 according to the invention along the line where the joint is to be formed, with the dowels 10 lying on their sides in the stone base 22. The slip dowels 10 will be aligned with their ends 32 and 34 extending parallel to the ends 32 and 34 of adjacent slip dowels 10 and perpendicular to the joint. The slip sleeves 12 are loosely on at least one end 32 of each slip dowel 10 rod.

Figure 3A:
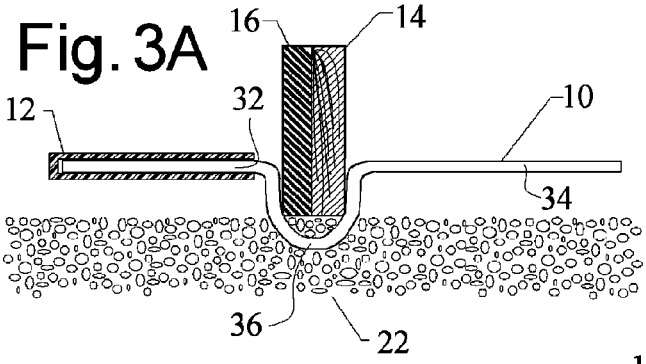
FIG. 3A is a schematic cross sectional view of the concrete slip dowel of FIG. 1A.

The frame member 14 with expansion member 16 is placed in position to complete the form. The remaining portions of the frame are not shown but their construction is well known in the art. The frame member 14 and expansion member 16 are placed to effectively extend across the base of the U shaped intermediate coupling rod of each rod 10. Each rod 10 is then pivoted up about the base of the U shaped intermediate coupling rod to position the frame member 14 and expansion member 16 within the U shaped intermediate coupling rod as shown in the FIGS. 1A and 2A, wherein the ends of the rod are positioned at a height roughly ½ of the height of the associated slab 18 or 20 to be poured. A pin can be used to secure the dowel rod 10 in the desired position, with the pin driven into the ground and further supporting the frame member 14, or driven into the frame member 14. Alternatively the rods 10 can be supported via a concrete chair, which is a small generally plastic support member resting on the bed 22 that will be encased in the respective slab 18 or 20. At this point each of the dowels 10 should be in a final position with their ends parallel to each other and perpendicular to the joint and about mid-height of the soon to be poured respective slabs 18 or 20. One end of each dowel in the area of slab 18 opposite the frame 14 will have the sleeve 12 as shown in FIG. 3A. It should be apparent that the same size dowel can be used for a range of concrete thicknesses as the rotation placement step can adjust the height throughout an entire range of heights up to the full height of the individual dowel rods 10.

Figure 4A:
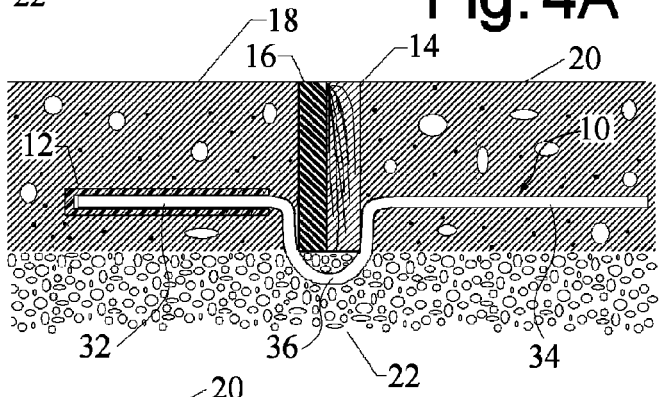
FIG. 4A is a schematic cross sectional view of the concrete slip dowel of FIG. 1A following a continuous pour of adjacent slabs in accordance with the present invention.
Figure 5A:
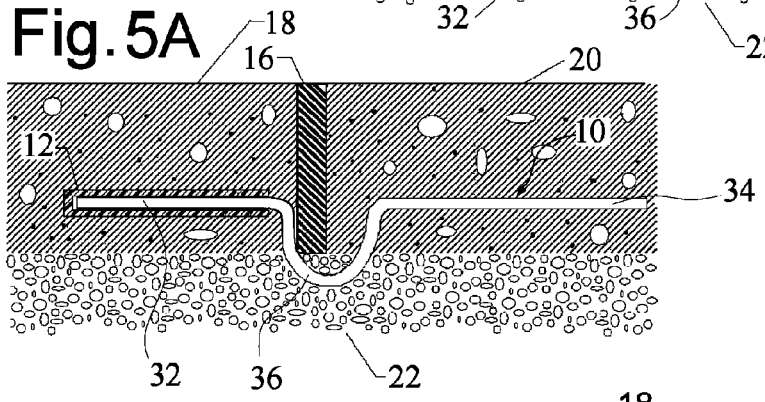
FIG. 5A is a schematic cross sectional view of the concrete slip dowel of FIG. 1A following a continuous pour of adjacent slabs in accordance with the present invention.

The next step is to pour the first slab 18 to the expansion member 16 and to continue to pour the adjacent slab 20 in a single continuous pour leaving the frame member 14 in position as shown in FIG. 4A. The frame member 14 can be removed after the concrete 20 has begun to firm up or set and the area vacated by the removed frame member 14 back filled and finished in conventional concrete working fashion as shown in FIG. 5A. The dowel rods 10 will be encased and secured to one slab 20 and allowed to move relative to the other slab due to the sleeves 12 of each dowel rod 10.

It should be noted that the leg of the U shaped intermediate coupling rod portion 36 that is on the side of the sleeve 12 in slab 18 will not be sufficiently secured to the slab 18 to prevent relative motion due to expansion and relative lateral motion of slab 20 to which the rod 10 is secured. This is mainly because the leg of the U shaped intermediate coupling rod portion 36 is effectively at the edge of the slab 18 and the expansion member 16, by design, accommodates the associated lateral motion. The U shape is also believed to assist in the relative lateral motion. These factors allow the sleeve 12 to be formed as shown in figures 1A, 2A, 3A, 4A and 5A, which is a simple plastic tubular configuration that is currently commercially available.

Figure 6:
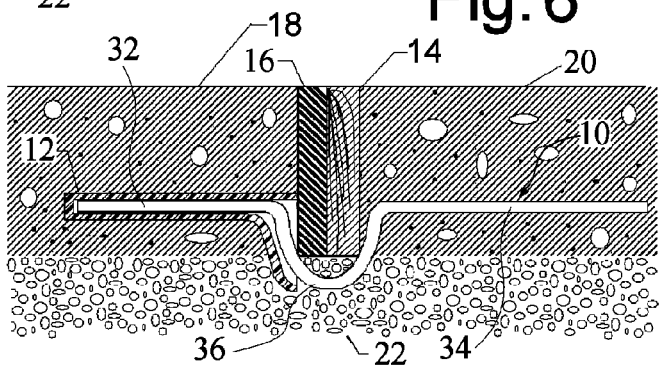
FIG. 6 is a schematic cross sectional view of the concrete slip dowel of a further embodiment of the present invention following a continuous pour of adjacent slabs in accordance with the present invention.
Figure 3B:
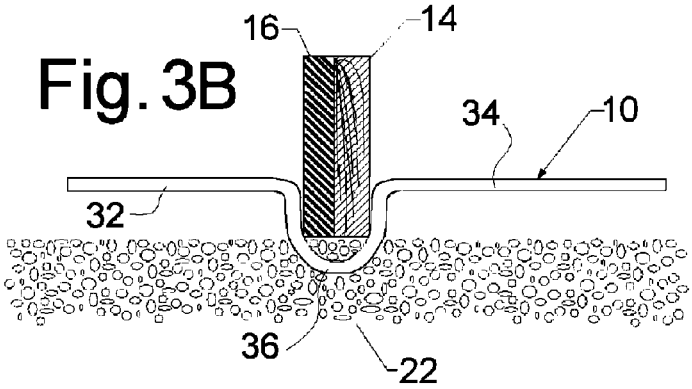
FIG. 3B is a schematic cross sectional view of the concrete slip dowel of FIG. 1B.

An alternative sleeve 12 configuration is shown in FIGS. 6-7, which is designed to assure that the entire rod on the one side of the joint can slide in and out of the sleeve 12. In this modification the end of the sleeve 12 is enlarged to accommodate portions of the U shaped intermediate coupling rod 36 as shown, and will prevent concrete forming slab 18 from attaching to any portion of the rod. The slip dowel 10 of FIGS. 6-7 operates in the same manner as the dowel of FIGS. 1-5, other than the construction of the "wide mouth" sleeve 12. The modified sleeve of FIGS. 6-7 could be formed as a one piece molded structure or, alternatively, as a two piece construction. The two piece modified "wide mouth" sleeve 12 construction allows a conventional sleeve 12 to be used with a second add on member forming the "wide mouth" end that receives the U shaped intermediate coupling rod, with the add on portion snapped, glued or otherwise affixed to the first sleeve portion.

The sliding mechanism in one embodiment of the invention shown in FIGS. 1B, 2B, 3B, 4B, and 5B can take the form of a relatively smooth exterior of the first rod end 32 which is coated to prevent attachment of the concrete during setting. The "relatively smooth" exterior means no projections 38 as commonly found on rebar. With the use of a coating as noted below, minor surface texturing (e.g. knurling) will still provide a relatively smooth exterior surface sufficient for this embodiment, but no such surface texturing is preferred, at least on end 32. The coating, not shown, may be tar, pitch, grease, petroleum gels or the like which prevent the setting concrete in the poured slab 18 from attaching to the first end 32 of the rod during setting, thus the coating can be considered as forming a non-solid, or semisolid slip sleeve. In this embodiment the rod 10 can be formed in the same manner as discussed above but a smooth bar not having projections 38 (i.e. not rebar or the like) is utilized.

In operation the slip dowel 10 of the present invention shown in FIGS. 1B, 2B, 3B, 4B, and 5B operates as follows. The dowel 10 is appropriate for use whenever there is a joint between adjacent slabs 18 and 20 to be poured. The concrete contractor will place a plurality of the slip dowels 10 according to the invention along the line where the joint is to be formed, with the dowels 10 lying on their sides in the stone base 22. The slip dowels 10 will be aligned with their ends 32 and 34 extending parallel to the ends 32 and 34 of adjacent slip dowels 10 and perpendicular to the joint. At least one end 32 of each slip dowel 10 rod will be coated with a coating such as tar, pitch, grease, petroleum gels or the like which prevent the setting concrete in the poured slab 18 from attaching to the first end 32 of the rod during setting. The coating may be pre-applied and can include an outer wrap or covering for ease of use in transport and installation. It should be apparent that such a thin wrap over a coating would not need to be removed, in which case in the final use the wrap and coating act as a semi-solid sleeve preventing the concrete of slab 18 from attaching to the end 32 of rod 10 during setting.

The frame member 14 with expansion member 16 is placed in position to complete the form as noted above in the first embodiment wherein the frame member 14 and expansion member 16 are placed to effectively extend across the base of the U shaped intermediate coupling rod of each rod 10. Each rod 10 is then pivoted up about the base of the U shaped intermediate coupling rod to position the frame member 14 and expansion member 16 within the U shaped intermediate coupling rod as shown in the FIGS. 1B and 2B, wherein the ends of the rod are positioned at a height roughly ½ of the height of the associated slab 18 or 20 to be poured. Again a pin or a concrete chair can be used to position the rod 10. At this point each of the dowels 10 should be in a final position with their ends 32 and 34 parallel to each other and perpendicular to the joint and about mid-height of the soon to be poured respective slabs 18 or 20. One end 32 of each dowel in the area of slab 18 opposite the frame 14 will have the coating. It should be apparent that the same size dowel can be used for a range of concrete thicknesses as the rotation placement step can adjust the height of the ends 32 and 34 throughout an entire range of heights up to the full height of the individual dowel rods 10.

Figure 4B:
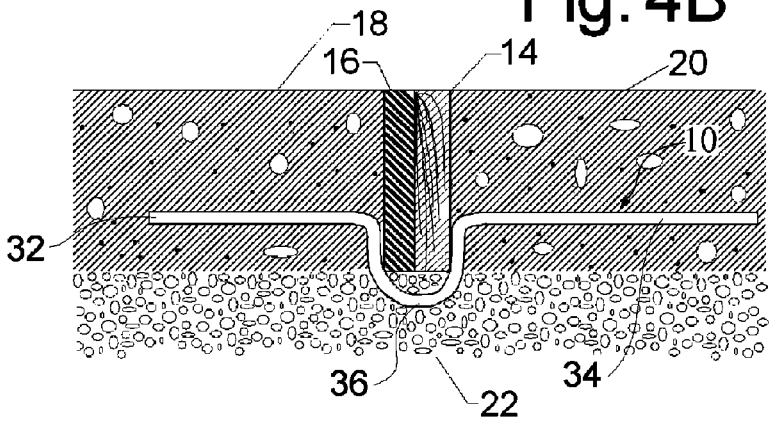
FIG. 4B is a schematic cross sectional view of the concrete slip dowel of FIG. 1B following a continuous pour of adjacent slabs in accordance with the present invention.
Figure 5B:
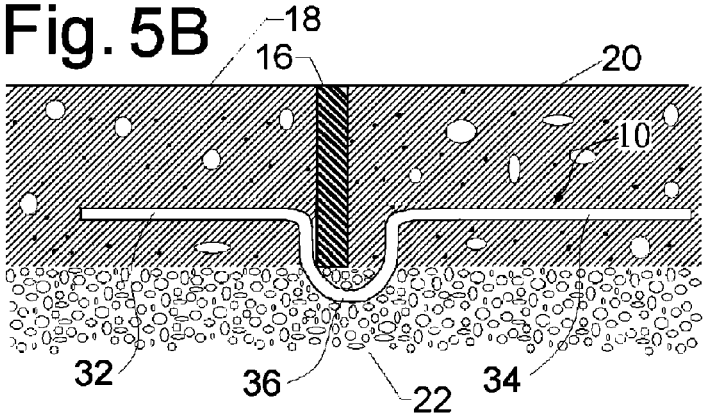
FIG. 5B is a schematic cross sectional view of the concrete slip dowel of FIG. 1B following a continuous pour of adjacent slabs in accordance with the present invention.

The next step is to pour the first slab 18 to the expansion member 16 and to continue to pour the adjacent slab 20 in a single continuous pour leaving the frame member 14 in position as shown in FIG. 4B. The frame member 14 can be removed after the concrete 20 has begun to firm up or set and the area vacated by the removed frame member 14 back filled and finished in conventional concrete working fashion as shown in FIG. 5B. The dowel rods 10 will be encased and secured to one slab 20 and allowed to move relative to the other slab due to the slipping mechanism formed by the smooth exterior of rod 10 and the additional coating on end 32 of each dowel rod 10.

FIG. 2C illustrates a modified rod 10 similar to that shown in FIG. 2B wherein one end 34 included projections 38 like conventional rebar. In this embodiment a coating could be used with the opposite end in accordance with the above discussion associated with FIG. 2B. Alternatively the provisions of projections on one end 34 may make this end gripped with sufficiently greater force by the concrete of slab 20 that the smooth end 32 does not need a coating to be applied to allow for the smooth end 32 to slip relative to the set slab 18. The difficulty with the embodiment of FIG. 2C is that it is a specialized construction that may be too costly to implement. A further modification is that the ends 32 and 34 of the rod need not be parallel to each other. The end 34 of the rod opposite from the sleeve 12 could be a zig-zag pattern or the like to facilitate bonding to the concrete slab 20, if desired. Such a non-linear pattern should be minimal and generally aligned with the axis of the other end to maintain the structure in the middle of the slab 20. This alternative is only identified to show the range of the present invention, but is not generally believed to add sufficient advantages to warrant the additional fabrication costs. The design as shown in FIGS. 1-5 represents the most cost effective, simple solution of the present invention.

Whereas particular embodiments of the invention have been described above for purposes of illustration, it will be evident to those skilled in the art that numerous variations of the details of the present invention may be made without departing from the spirit and scope of the present invention.

What is claimed is:

1. A continuous pour concrete slip dowel formed of a main dowel rod configured to extend across a joint comprising:
   i) a first rod end configured to be received within a first concrete slab on one side of a joint,
   ii) a second opposed rod end configured to be received within a second concrete slab which is adjacent the first slab and spaced from the first slab by the intervening joint,
   iii) an intermediate coupling rod portion connecting the first rod end with the second rod end, wherein the intermediate coupling rod is integral with the first rod portion and with the second rod portion, and wherein the coupling rod portion defines an offset therein whereby the coupling rod portion is configured to extend around the joint;
   iv) a sliding mechanism that is associated with at least the first rod end of the dowel and is configured to provide a sliding relationship between the first rod end and the concrete slab.

2. The continuous pour concrete slip dowel of claim 1 wherein the intermediate coupling rod portion connecting the first rod end with the second rod end is formed as a U-shaped intermediate coupling rod.

3. The continuous pour concrete slip dowel of claim 2 wherein the first and second ends of the rod are positioned at a height roughly ½ of the height of the associated slabs.

4. The continuous pour concrete slip dowel of claim 2 wherein the rod is formed of ½ inch diameter steel rebar member with projections on an outer surface thereof.

5. The continuous pour concrete slip dowel of claim 4 wherein sliding mechanism is formed of a slip sleeve configured to be positioned within a first concrete slab and wherein the first rod end portion configured to be received within the slip sleeve.

6. The continuous pour concrete slip dowel of claim 2 wherein sliding mechanism is formed of a smooth exterior on the first rod end and a coating on the first end which is coated to prevent attachment of the concrete during setting.

7. The continuous pour concrete slip dowel of claim 6 wherein the coating is one of tar, pitch, grease, and petroleum gels.

8. The continuous pour concrete slip dowel of claim 2 wherein the first and second ends of the rod are parallel to each other.

9. The continuous pour concrete slip dowel of claim 8 wherein the first and second ends of the rod are co-axial.

10. A continuous pour concrete slip dowel formed of a main dowel rod configured to extend across a joint comprising:
   i) a first rod end having a smooth exterior and configured to be received within a first concrete slab on one side of a joint,
   ii) a second opposed rod end configured to be received within a second concrete slab which is adjacent the first slab and spaced from the first slab by the intervening joint,
   iii) an intermediate coupling rod portion connecting the first rod end with the second rod end, wherein the intermediate coupling rod is integral with the first rod portion and with the second rod portion, and wherein the coupling rod portion defines an offset therein whereby the coupling rod portion is configured to extend around the joint; and iv) a coating on the first end to prevent attachment of the concrete of the first slab during setting thereby providing a sliding relationship between the first rod end and the concrete slab.

11. The continuous pour concrete slip dowel of claim 10 wherein the coating is one of tar, pitch, grease, and petroleum gels.

12. The continuous pour concrete slip dowel of claim 10 wherein the first and second ends of the rod are parallel to each other.

13. The continuous pour concrete slip dowel of claim 12 wherein the first and second ends of the rod are co-axial.

14. The continuous pour concrete slip dowel of claim 10 wherein the intermediate coupling rod portion connecting the first rod end with the second rod end is formed as a U-shaped intermediate coupling rod.

15. The continuous pour concrete slip dowel of claim 14 wherein the first and second ends of the rod are positioned at a height roughly ½ of the height of the associated slabs.

16. The continuous pour concrete slip dowel of claim 10 wherein the rod is formed of ½ inch diameter steel member.

17. A continuous pour concrete slip dowel comprising

A) a slip sleeve configured to be positioned within a first concrete slab; and

B) a main dowel rod having i) a first rod end portion configured to be received within the slip sleeve, ii) a second opposed rod end configured to be received within a second concrete slab which is adjacent the first slab and spaced from the first slab by a intervening joint, and iii) an intermediate coupling rod portion connecting the first rod end with the second rod end, wherein the intermediate coupling rod is integral with the first rod portion and with the second rod portion, and wherein the coupling rod portion defines an offset therein whereby the coupling rod portion is configured to extend around the joint.

18. The continuous pour concrete slip dowel of claim 17 wherein the intermediate coupling rod portion connecting the first rod end with the second rod end is formed as a U-shaped intermediate coupling rod.

19. The continuous pour concrete slip dowel of claim 18 wherein the first and second ends of the rod are positioned at a height roughly ½ of the height of the associated slabs.

20. The continuous pour concrete slip dowel of claim 18 wherein the rod is formed of ½ inch diameter steel rebar member with projections on an outer surface thereof.

* * * * *